US005842941A

United States Patent [19]

Siminski et al.

[11] Patent Number: 5,842,941

[45] Date of Patent: Dec. 1, 1998

[54] BASKETBALL BACKBOARD ASSEMBLY

[76] Inventors: Robert M. Siminski, 2311 Lloyd Ave.; Michael G. Linihan, 623 Parkdale, both of Royal Oak, Mich. 48073

[21] Appl. No.: 910,333

[22] Filed: Aug. 13, 1997

[51] Int. Cl.[6] ..... A63B 63/08

[52] U.S. Cl. ..... 473/481; 473/486; 273/157 R

[58] Field of Search ..... 473/472, 479, 473/480, 481, 485, 486, 487, 488

[56] References Cited

U.S. PATENT DOCUMENTS

| | | | |
|---|---|---|---|
| D. 170,645 | 10/1953 | Logue | 273/157 R X |
| 4,083,123 | 4/1978 | Livermore | 273/157 R X |
| 4,320,896 | 3/1982 | Engle et al. | 473/481 |
| 4,805,918 | 2/1989 | Feinberg | 273/157 R X |
| 4,834,369 | 5/1989 | Walsh | 483/481 |
| 5,064,195 | 11/1991 | McMahan et al. | 483/480 |

*Primary Examiner*—William H. Grieb

[57] ABSTRACT

A basketball backboard assembly comprising a body including a plurality of selectively releasable interfitting pieces and a rim extending from the body is disclosed whereby upon generating a sufficient force on the rim, the plurality of interfitting pieces release from each other to simulate a shattered backboard.

25 Claims, 4 Drawing Sheets

BASKETBALL BACKBOARD ASSEMBLY

FIELD OF THE INVENTION

The present invention relates to basketball backboard assemblies. More specifically, the present invention relates to basketball backboard assemblies in which a player can selectively simulate a shattering of the backboard.

BACKGROUND

The game of basketball generally includes a basketball and a hoop mounted to a backboard at a certain height above the ground wherein the goal of the game is to put the basketball through the hoop a certain number of times or as often as possible in a predetermined amount of time.

Over the years, the game has evolved from a relatively slow paced game to a very fast paced game, particularly at the professional level. As such, one of the most exciting plays to develop in the game has been the "slam dunk". To perform a slam dunk, players generally jump toward the hoop with the basketball in their hands, and then forcefully put the ball through the hoop.

The slam dunk shot itself has reached such popularity that slam dunk contests are held for players at various levels. In fact, slam dunk contests are now commonly staged as a feature of basketball competitions such as all-star games, for example.

Of the various types of slam dunks which are commonly attempted, very few have the impact on an audience as those which result in a shattered backboard wherein the backboard is caused to break apart in many fragmented pieces.

While the sight and sound of witnessing a shattered backboard is appealing, the reality is that very few players are actually strong enough to accomplish the task. For children, the possibility of shattering a backboard is virtually non-existent. As such, an object of the present invention is to provide a basketball backboard assembly which affords a player the opportunity to simulate the shattering of a backboard as the result of a slam dunk.

This object, among others, is accomplished utilizing a basketball backboard assembly comprising:

- a body including a plurality of selectively releasable interfitting pieces; and
- a rim attached to said body which extends outwardly therefrom;
- whereby upon generating a sufficient force upon said rim the plurality of interfitting pieces release from each other to simulate a shattered backboard.

Another object of the present invention is to provide a basketball backboard assembly wherein the simulated shattering of the backboard will not only include a visual simulation but an audible simulation of the unique sound heard when a tempered glass backboard is shattered.

Yet another object of the present invention is to provide a backboard assembly which is useful for basketball games wherein a simulated shattering of the backboard is optional.

Still another object of the present invention to provide a basketball backboard assembly which can be readily reassembled into a useful basketball backboard after the occurrence of a backboard shattering slam dunk.

The present invention is capable of fulfilling one or more of the foregoing objects in addition to many others which will become more apparent upon reviewing the drawings, detailed description of the invention and various claims.

DETAILED DESCRIPTION OF THE PREFERRED EMBODIMENTS

While it is contemplated that the present invention is primarily concerned with basketball backboard assemblies which are useful as toys employing lightweight basketballs, in an effort to broadly describe the invention, the basketball backboard assemblies of the present invention will be described generally and without limitation.

Figure 1:
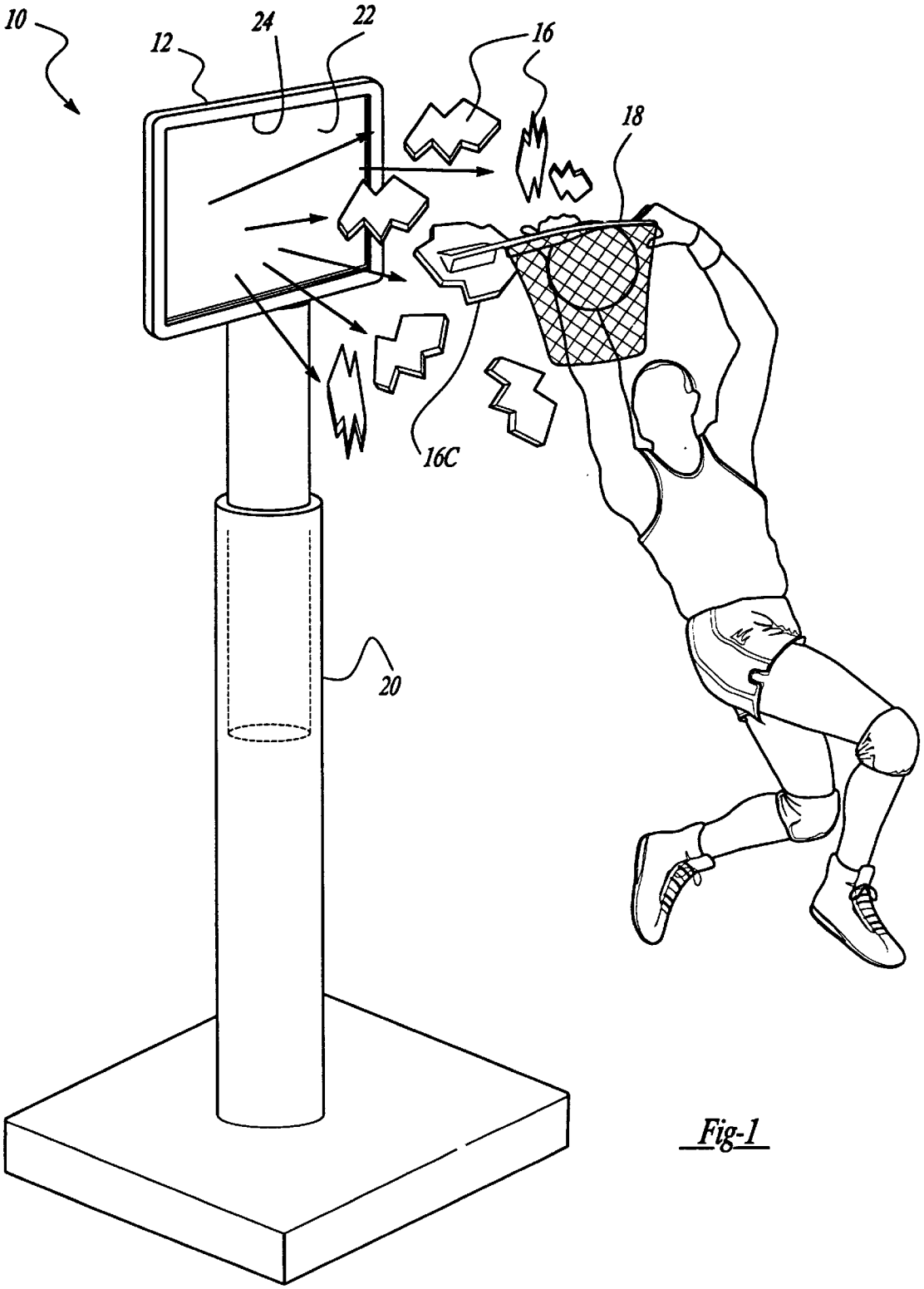
FIG. 1 is a perspective view of a basketball backboard assembly according to the present invention.
Figure 2:
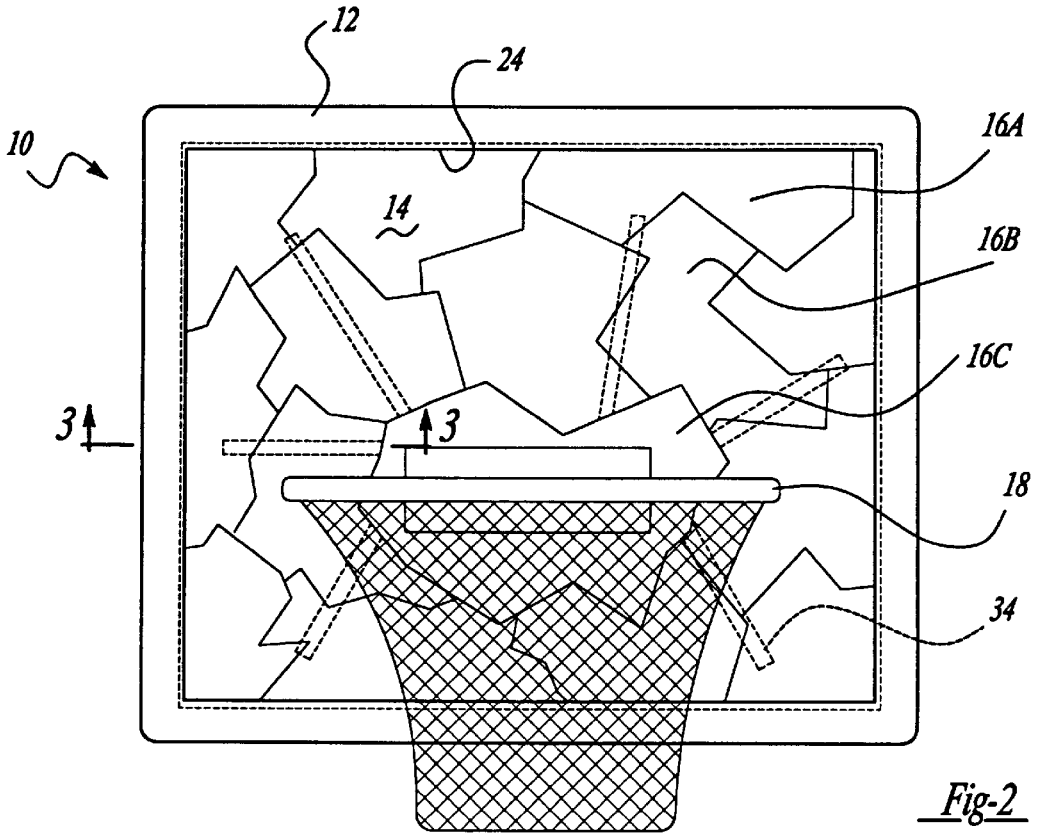
FIG. 2 is a elevation view of a basketball backboard assembly of FIG. 1.

Referring to FIG. 1, the basketball backboard assembly 10 generally includes a backboard frame structure 12, a body 14 including a plurality of selectively releasable interfitting backboard pieces 16 and a rim 18.

Figure 3:
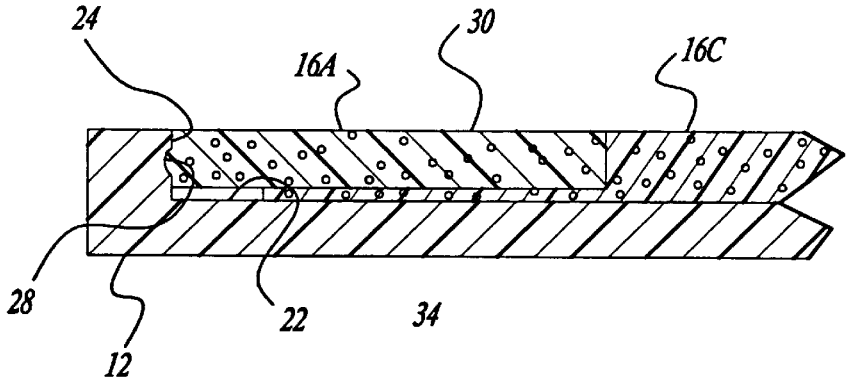
FIG. 3 is a partial sectional view of the basketball backboard assembly of FIGS. 1 - 2 shown in an assembled position.
Figure 4:
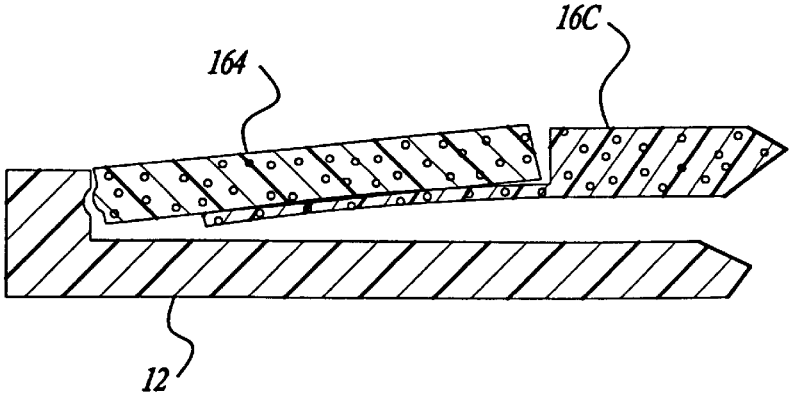
FIG. 4 is a partial sectional view of the basketball backboard assembly of FIGS. 1 and 2 shown as the backboard is becoming disassembled in response to a slam dunk simulative of a shattered backboard.
Figure 5:
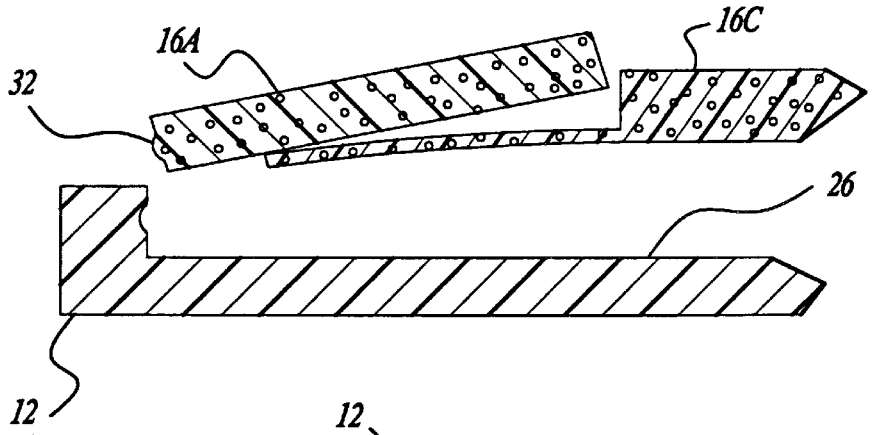
FIG. 5 is a partial sectional view of the basketball backboard assembly of FIGS. 1 and 2 in a fully disassembled state.

The backboard frame structure 12, when employed, generally includes a backing 22 and a border 24 disposed about the periphery of the backing. As shown in FIGS. 3–5, the border 24 extends traversely from the backing 22 to provide a cavity 26 within which the backboard pieces 16 are inserted. The border 24 preferably includes a groove 28 for receiving pieces of the backboard body 14 in a tongue-and-groove relationship. Preferably the frame structure 12 is made from a lightweight plastic material via known molding techniques or is made from a cellulosic material such as fiberboard, for example.

The body 14 and, more particularly, the plurality of interfitting pieces 16 are preferably made from a lightweight plastic or foamed material as shown. The individual pieces 16A, 16B, and 16C generally have an irregular geometry or shape when viewed from the front. However, when all of the pieces are assembled in a puzzle-like fashion, the entire plurality of pieces fully occupy the cavity 26. Further, the plurality of pieces 16 when assembled to form the body will preferably result in a substantially planar surface 30 off which basketballs can be deflected when a bank shot is attempted. Thus, not only does the basketball backboard assembly of the present invention allow a player to simulate a shattering of the backboard, but also allows players to play a basketball game if so desired.

As previously alluded to, at least certain of the plurality of pieces 16, namely the edge pieces 16A, are provided with an extending tongue portion 32 which seats within the groove 28 provided along the periphery of the frame to assist in maintaining the backboard in an assembled state until a sufficiently forceful dunk is carried out. Additionally, the interior pieces 16B may be provided with a tongue-and-groove construction (not shown) relative to other interior and edge pieces or may be press fit into an assembled state as shown in FIGS. 1 and 6, particularly.

Figure 9:
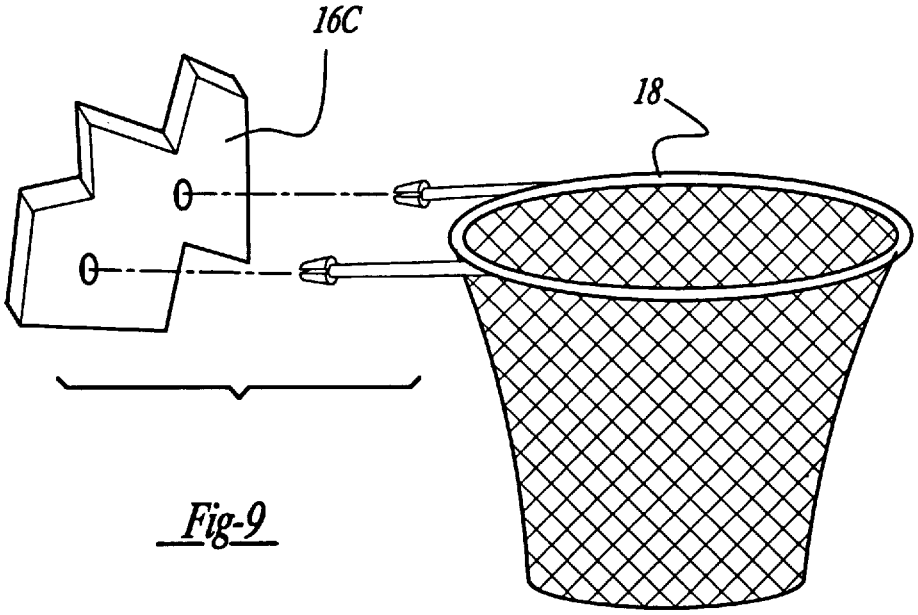
FIG. 9 is a side elevation view of a rim selectively attached to a backboard body.

A rim piece 16C is also provided which is similar to backboard pieces 16A and 16B, except that rim piece 16C includes a transversely extending rim 18. The rim 18 which is either integrally formed with the rim piece 16C as shown in FIG. 1 or snap-fit thereto as shown in FIG. 9 is designed to allow the passage of a basketball therethrough. Thus, the diameter of rim 18 is roughly twice the diameter of the basketball to be used in association with the assembly.

Figure 6:
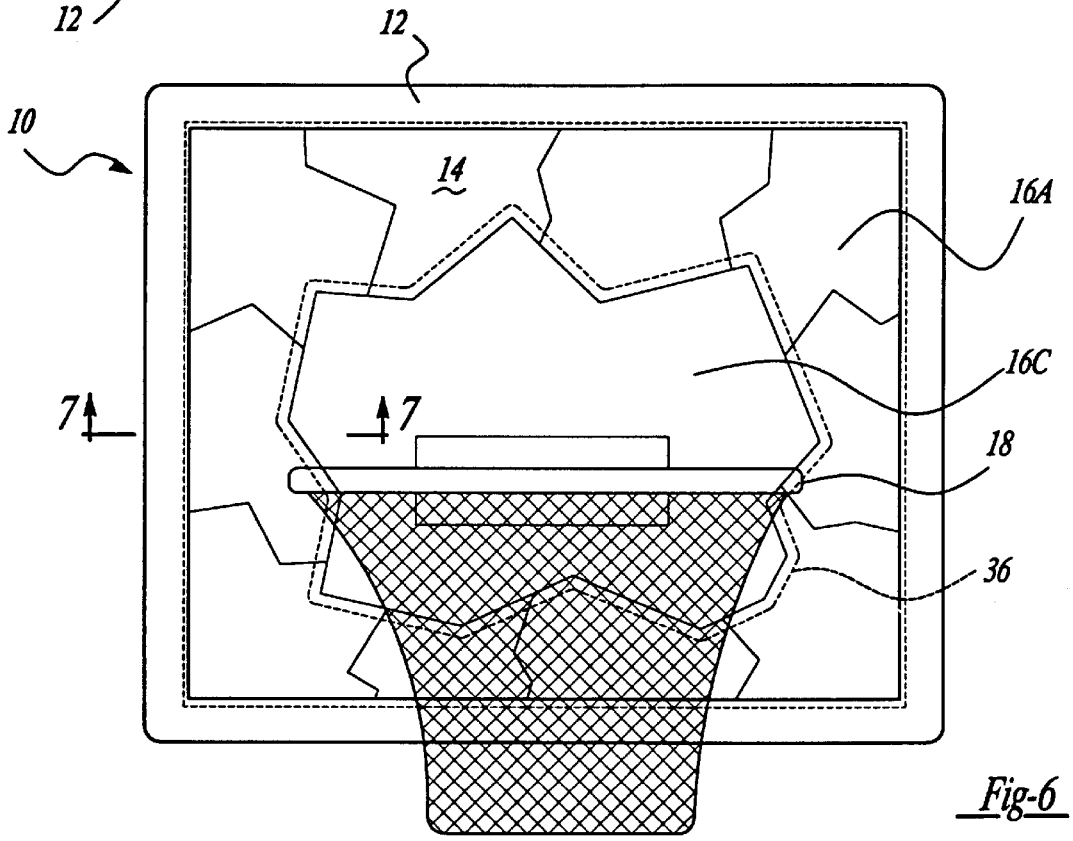
FIG. 6 is an elevation view of an alternative basketball backboard assembly embodiment according to the present invention.
Figure 7:
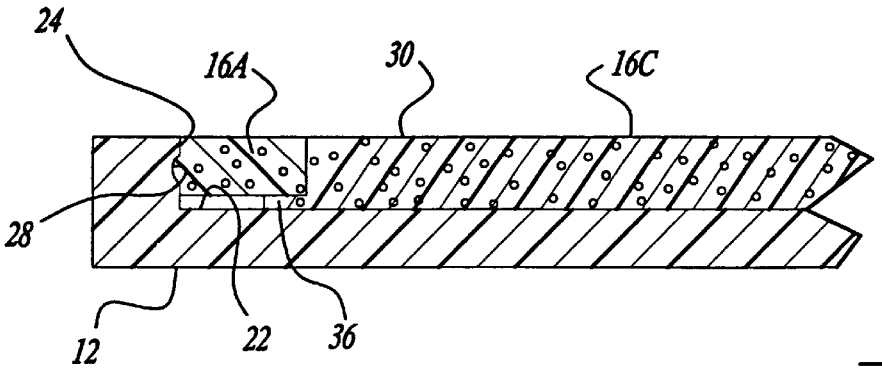
FIG. 7 is a partial sectional view of the basketball backboard assembly of FIG. 6.

The rim piece 16C preferably includes means for selectively disengaging one or more adjacent interfitting pieces in the form of a plurality of radially extending fingers 34 as shown in FIGS. 2–5 or a shoulder 36 as shown in FIGS. 6 and 7. The fingers 34 which are designed to contact all or nearly all of backboard pieces 16 when mounted in backboard frame structure 12, are integrally formed with rim piece 16C and thus are made of a similar material. Preferably the fingers will be slightly arcuate similar to a leaf spring. In use, when a sufficient force is generated upon the rim and thus the rim piece 16C, the fingers 34 contact a sufficient number of other pieces 16A and 16B to cause many of the pieces to project away from the backboard thereby simulating a shattered backboard. Similarly, shoulder 36 is designed to contact all or nearly all of backboard pieces 16A and 16B, as shown in FIG. 6 to assist in pulling them away from the backboard frame.

Figure 8:
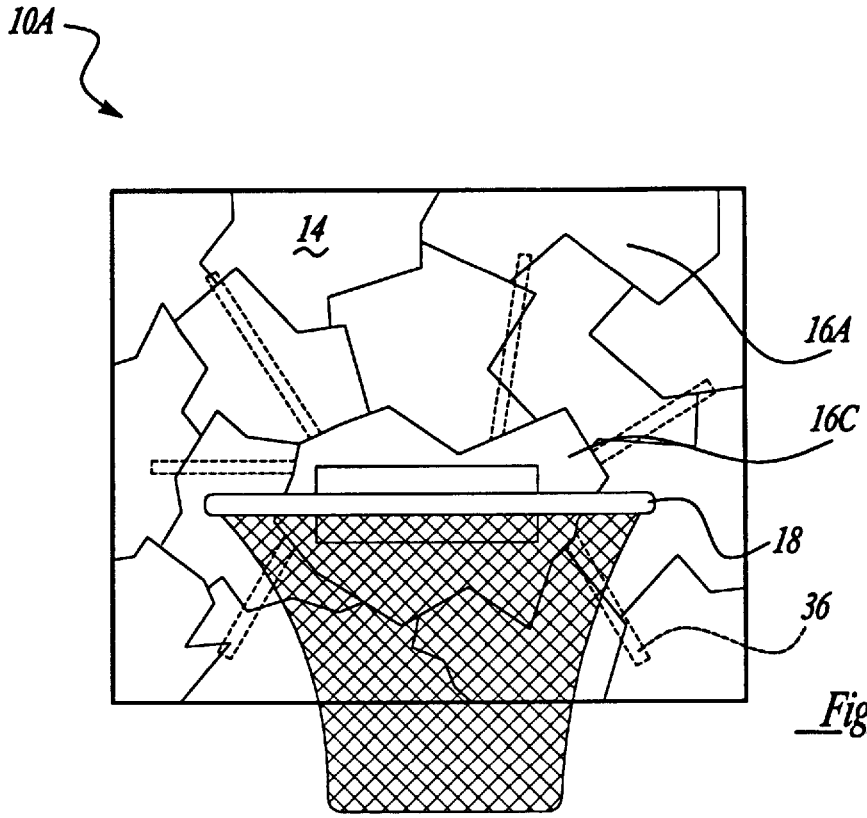
FIG. 8 is an elevation view of a frameless basketball backboard assembly according to one embodiment of the present invention.

Referring to FIG. 8, there is shown an alternative embodiment of the basketball backboard assembly in accordance with the teachings of the present invention. According to this embodiment, the assembly 10A is essentially frameless. When assembled, the plurality of selectively releasable interfitting pieces 16A and 16C form the backboard assembly proper. Again, the interfitting pieces may include a tongue-and-groove arrangement to assist in maintaining the assembly in a useful construction prior to carrying out a dunk to simulate a shattered backboard.

Optionally, the basketball backboard assemblies 10 and 10A respectively, may also include a circuit between the plurality of the pieces 16 whereby upon interrupting the continuity of the circuit by forcing disengagement between the pieces, an audible alarm simulative of a shattered tempered glass backboard is sounded. Thus, not only does the present invention provide a visual simulation of a shattered backboard but also may provide an audible simulation as well.

As should be understood by those skilled in the art, the backboard assemblies 10 and 10A are suspendable from a structure such as the stand designated by reference numeral 20 in FIG. 1 or optionally may be mounted to extend from a surface such as a wall or door, for example.

The invention has been described in an illustrative manner, and it is to be understood that the terminology which has been used is intended to describe the invention in a non-limiting manner. As such it should be appreciated that the invention is susceptible to modification, variation and change without departing from the proper scope and fair meaning of the accompanying claims.

We claim:

1. A basketball backboard assembly, comprising:

a frame structure;

a body attachable to said frame structure including a plurality of selectively releasable interfitting pieces; and a rim attached to said body and extending outwardly therefrom;

whereby upon generating a sufficient force upon said rim, said plurality of interfitting pieces release from each other and from said frame structure to simulate a shattered backboard.

2. The basketball backboard assembly of claim 1, wherein said plurality of interfitting pieces include a tongue-and-groove attachment between adjacent pieces.

3. The basketball backboard assembly of claim 1, wherein said frame structure includes a backing and a border extending transversely from said backing, said backing and said border defining a cavity for hosting said plurality of selectively releasable interfitting pieces.

4. The basketball backboard assembly of claim 3, wherein said border includes a groove for receiving a portion of said interfitting pieces.

5. The basketball backboard assembly of claim 1, wherein at least one of said plurality of selectively releasable interfitting pieces include means for selectively disengaging an adjacent interfitting piece from said frame structure.

6. The basketball backboard assembly of claim 5, wherein said means for selectively disengaging an adjacent interfitting piece from said frame structure includes a shoulder disposed about the periphery of said at least one interfitting piece.

7. The basketball backboard assembly of claim 1, wherein said rim is integrally attached to one of said interfitting pieces.

8. The basketball backboard assembly of claim 1, wherein at least one of said plurality of interfitting pieces include radially extending fingers which seat against an adjacent interfitting piece to assist in releasing said interfitting pieces from said frame.

9. The basketball backboard assembly of claim 1, wherein said plurality of interfitting pieces are made from a plastic material.

10. The basketball backboard assembly of claim 1 wherein said plurality of interfitting pieces are made from a foamed material.

11. The basketball backboard assembly of claim 1, wherein said plurality of interfitting pieces are irregularly shaped.

12. The basketball backboard assembly of claim 1, wherein said plurality of interfitting pieces include a substantially planar surface off which a basketball can be deflected.

13. The basketball backboard assembly of claim 1, further comprising an audible signal which is generated in response to the release of said interfitting pieces.

14. A toy basketball backboard assembly, comprising:

a body including a plurality of selectively releasable interfitting pieces; and a rim extending transversely from said body;

whereby upon generating a sufficient force upon said rim, said plurality of interfitting pieces release from each other to simulate a shattered backboard.

15. The toy basketball backboard assembly of claim 14, wherein said plurality of interfitting pieces include a tongue-and-groove attachment.

16. The toy basketball backboard assembly of claim 14, wherein at least one of said plurality of selectively releasable interfitting pieces include means for selectively disengaging an adjacent interfitting piece.

17. The toy basketball backboard assembly of claim 16, wherein said means for selectively disengaging an adjacent interfitting piece includes a shoulder disposed about the periphery of said at least one interfitting piece.

18. The toy basketball backboard assembly of claim 14, wherein said rim is attached to one of said interfitting pieces.

19. The toy basketball backboard assembly of claim 14, wherein at least one of said plurality of selectively releasable interfitting pieces include radially extending fingers which seat against an adjacent interfitting piece to assist in releasing said interfitting pieces from each other.

20. The toy basketball backboard assembly of claim 14, wherein said plurality of interfitting pieces are irregularly shaped.

21. The toy basketball backboard assembly of claim 14, wherein said plurality of interfitting pieces are made of a plastic material.

22. The toy basketball backboard assembly of claim 14, wherein said plurality of interfitting pieces are made of a foamed material.

23. The toy basketball backboard assembly of claim 14, wherein said plurality of interfitting pieces include a substantially planar surface off which a toy basketball can be deflected.

24. The toy basketball backboard assembly of claim 14, wherein the said plurality of selectively releasable interfitting pieces are attachable to a frame.

25. The basketball backboard assembly of claim 14, further comprising an audible signal which is generated in response to the release of said interfitting pieces.

* * * * *